US007118309B2

(12) United States Patent
Jaecklin

(10) Patent No.: US 7,118,309 B2
(45) Date of Patent: Oct. 10, 2006

(54) COMPONENT FOR SPATIAL GRID SUPPORTING SYSTEMS COMPRISING FILLER MATERIAL ESPECIALLY FOR RETAINING WALLS OR NOISE-ABATEMENT WALLS, AND CORRESPONDING STRUCTURE

(76) Inventor: Felix Paul Jaecklin, Geissbergstrasse 46, Ennetbaden (CH) CH-5408

( * ) Notice: Subject to any disclaimer, the term of this patent is extended or adjusted under 35 U.S.C. 154(b) by 0 days.

(21) Appl. No.: 10/398,474

(22) PCT Filed: Oct. 4, 2001

(86) PCT No.: PCT/EP01/11433

§ 371 (c)(1),
(2), (4) Date: Sep. 24, 2003

(87) PCT Pub. No.: WO02/31286

PCT Pub. Date: Apr. 18, 2002

(65) Prior Publication Data

US 2004/0074193 A1 Apr. 22, 2004

(30) Foreign Application Priority Data

Oct. 4, 2000 (DE) ..... 100 49 136

(51) Int. Cl.
*E02D 17/00* (2006.01)

(52) U.S. Cl. ..... 405/284; 52/606

(58) Field of Classification Search ..... 52/35, 52/169.1, 608, 604, 712, 715, 606, 600, 603; 47/83; 405/286, 258, 284
See application file for complete search history.

(56) References Cited

U.S. PATENT DOCUMENTS 4,384,810 A * 5/1983 Neumann ..... 405/284

(Continued)

*Primary Examiner*—Naoko Slack
(74) *Attorney, Agent, or Firm*—Stevens, Davis, Miller & Mosher, LLP

(57) ABSTRACT

The invention relates to a component for spatial grid supporting systems comprising filler material, especially for retaining walls and/or noise-abatement walls. Said component comprises the following characteristics: a closed or open, single-element or multi-element frame body (RK) is provided, said frame body comprising at least one longitudinal member (LTF) which extends essentially along the front of the supporting system on the front side in relation to the mounting position. The frame body also comprises at least one cross member (QT) which extends at an angle, especially at a right angle, in relation to the longitudinal member. Said longitudinal member (LTF) has, at least in sections, a polygonal, especially square, cross-section which is defined by longitudinal surfaces which are essentially, or at least in sections, plane, said cross-section extending in a normal direction (N) to a frame plane (E—E) which is defined by the longitudinal member and the cross member. In view of the above criteria and others, including those relating to the aesthetic design of large-surface wall facades, to the multiple possibilities for use, including in hydraulic architecture, to resource economy and sustainability in addition to rational productivity, the aim of the invention is to create components which enable progress to be made in terms of at least one of the aforementioned criteria. In order to achieve this, the front surface (OF) and the rear surface (OR) of the longitudinal member (LTF) together form an angle between 2° and 15° which opens downwards in relation to the mounting position, and/or the front surface (OF) of the longitudinal member (LTF) is arranged in an inclined manner, ascending towards the inner part of the frame at an angle of between 2° and 15°, at least in sections as far as the normal direction (N) of the frame is concerned.

18 Claims, 4 Drawing Sheets

U.S. PATENT DOCUMENTS 4,671,706 A * 6/1987 Giardini ..... 405/286
5,017,050 A * 5/1991 Jaecklin ..... 405/284
5,139,369 A * 8/1992 Jaecklin ..... 405/262
5,181,351 A * 1/1993 Jaecklin ..... 52/35
5,484,234 A * 1/1996 Worden ..... 405/284
5,564,865 A * 10/1996 Jansson ..... 405/286
5,620,283 A * 4/1997 Walter ..... 405/286
5,658,098 A * 8/1997 Woolbright ..... 405/284
5,836,129 A * 11/1998 Jaecklin ..... 52/612
6,287,054 B1 * 9/2001 Egan et al. ..... 405/262
6,539,684 B1 * 4/2003 Graham ..... 52/609
6,685,400 B1 * 2/2004 Ruel et al. ..... 405/284

* cited by examiner

COMPONENT FOR SPATIAL GRID SUPPORTING SYSTEMS COMPRISING FILLER MATERIAL ESPECIALLY FOR RETAINING WALLS OR NOISE-ABATEMENT WALLS, AND CORRESPONDING STRUCTURE

FIELD OF INVENTION

The invention relates to a component for spatial grid supporting structures comprising filler material, especially for retaining walls or noise abatement walls, with the following features:

there is a closed or open frame body (RK) made in one piece or composed of several parts, with at least one rear longitudinal member (LTR) which extends with respect to the installation position with a distance from and essentially along the front of the support structure, and with at least one cross member (QT) which extends with respect to the installation position at an angle, especially essentially at a right angle, to the front of the support structure;

the longitudinal member (LTR) at least in sections has a triangular or polygonal, especially rectangular, cross section which is bordered by at least essentially or at least in sections planar longitudinal surfaces.

BACKGROUND OF THE INVENTION

Components of this type are common in the prior art. In the effort to use these structures for exposed retaining walls and/or noise abatement walls which are more highly stressed due to soil pressure for one thing, however there has been the necessity of undesirably large dimensions and material costs. With respect to this and other aspects, among others also aspects of aesthetic configuration of large-area wall fronts, versatility also in hydraulic construction and saving of resources and durability, and efficient manufacturing capacity, the object of this invention is to devise components which enable progress with respect to at least one of these criteria.

SUMMARY OF THE INVENTION

The object is achieved by the present invention by providing a component for a spatial grid supporting system which is made in one piece or is composed of several parts, with at least one longitudinal member which is on the front with respect to the installation position and which extends essentially along the front of the support structure, and with at least one cross member which extends at an angle, especially essentially at a right angle, to the front of the longitudinal member. The longitudinal member has at least in sections a polygonal, especially rectangular, cross section which is bordered by at least essentially or at least in sections planar longitudinal surfaces and which is elongated in the normal direction to a frame plane which is determined by the longitudinal and cross members.

The disclosure of this invention also comprises certain developments of the immediate subject matter of the invention which is defined in the claims. These developments are determined by the features of the dependent claims and have significant technical and inventive importance. Their features are however not absolutely necessary for advanced implementation of the immediate subject matter of the invention, but enable new optimization possibilities of it.

BRIEF DESCRIPTION OF THE DRAWINGS

Inventive features and important advantages are explained with reference to the embodiments which are shown schematically in the drawings, in which.

DETAILED DESCRIPTION OF THE INVENTION

Figure 1:
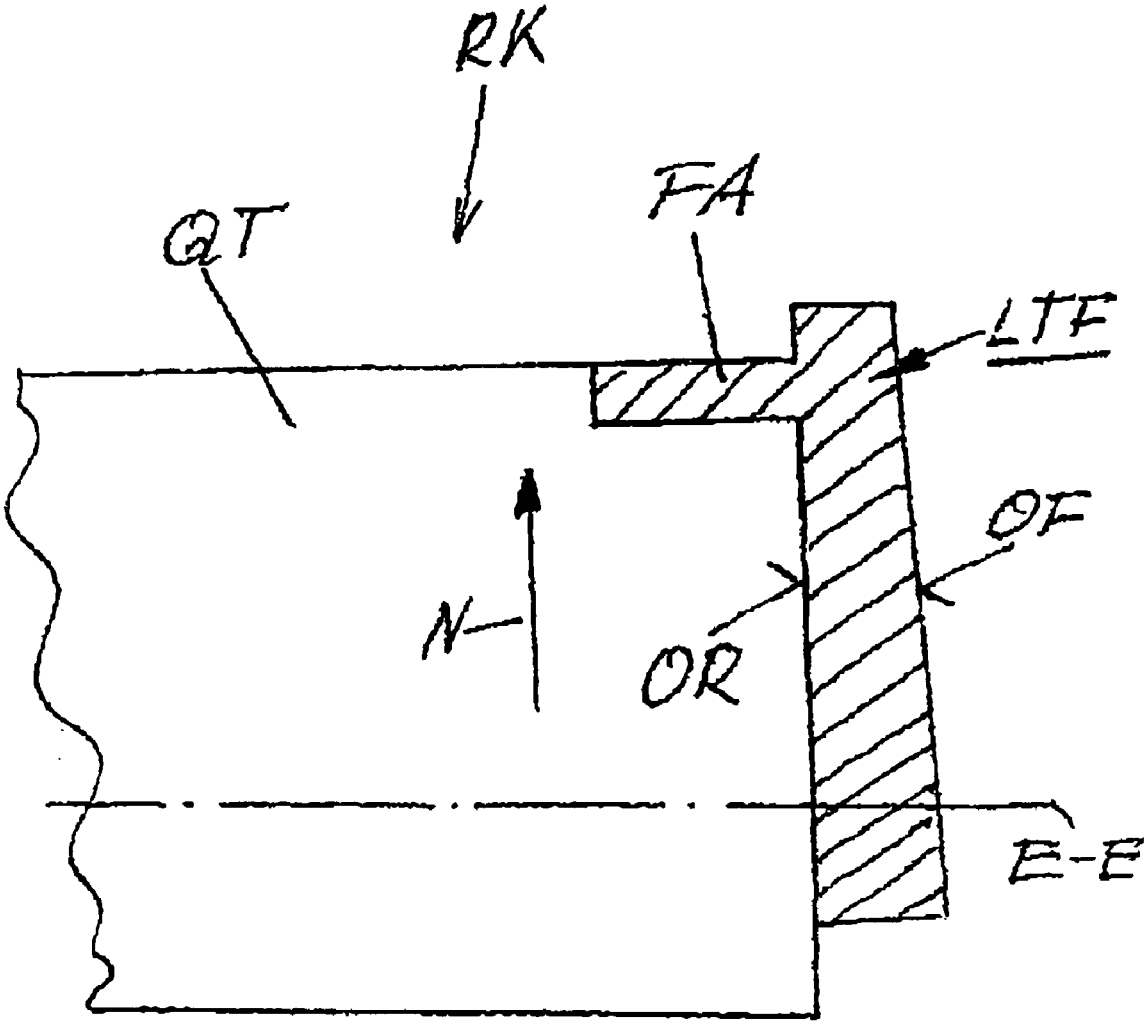
FIG. 1 is a cross sectional view of a front longitudinal member of a component according to the invention.

FIG. 1 shows within a framelike component the cross sectional profile of a front longitudinal member (LTF). The front surface (OF) and the rear surface (OR) of the longitudinal member (LTF) together form an angle between 2° and 15° which is open to the bottom with respect to the installation position. Furthermore it is advantageous if the front surface (OF) of the longitudinal member (LTF) is tilted ascending towards the frame interior at an angle between 2° and 15° at least in sections relative to the normal direction (N) of the frame. Then, on the frame-inside surface of the longitudinal member (LTF) and in the example in the area of the frame-inside top edge of the longitudinal member (LTF) there is at least one projecting flange section (FA).

In this version it is important that the front surface (OF) and the rear surface (OR) of the longitudinal member (LTF) with one another form an angle between 2° and 15° which is open to the bottom with respect to the installation position. Preferably, furthermore the front surface (OF) of the longitudinal member (LTF) at least in sections is tilted ascending toward the frame interior with respect to the normal direction (N) of the frame, at an angle between 2° and 15°.

The special properties of these configuration features are the following:

The front longitudinal members can form a closed outside wall surface, as is required for example for walls along a water course or for wharf walls. The front surfaces of the individual components have a slight gradient forward. In this way these surfaces are more strongly exposed to rain and are kept free of dirt. The front slabs of the components which are thicker to the bottom on the outer lower edge can form a drain projection so that rainwater does not penetrate into the interior of the space grid. In certain cases, for example with sufficient interior drainage, it can be desirable conversely to allow rainwater to drip, not onto the underlying front elements, but to drain it into the interior of the space grid; this leads to less fouling. The top edges of the front longitudinal members have a certain spacing, for example from 2 to 10 cm, from the top edges of the pertinent cross members which lie on top of one another in a tiered arrangement. Moreover, the front longitudinal members in cross section are slightly beveled on their frame inside in order to guide the component which is to be placed at the time into the correct position. Furthermore, in this way during storage and transport the danger of damage to the visible surfaces on their lower edges is reduced. Therefore the lower edges of the front longitudinal members have a distance of for example 3 to 11 cm which is greater with respect to the aforementioned top edge spacing from the lower edges of the pertinent cross members. In this way, between the front longitudinal members of the tiers on top of one another there is a horizontal gap of for example 0.5 to 1 cm thickness, while the pertinent cross members lie on one another. This ensures that high vertical loads are transferred only between the surface sections of the cross members, which sections lie on top of one another, but not via the fracture-sensitive and aesthetically relevant edges of the front longitudinal members.

Furthermore, a flange section (FA) which projects on the frame-inside surface of the front longitudinal member and which enables significant strengthening and stiffening of this member or major material savings acquires special importance.

Figure 2:
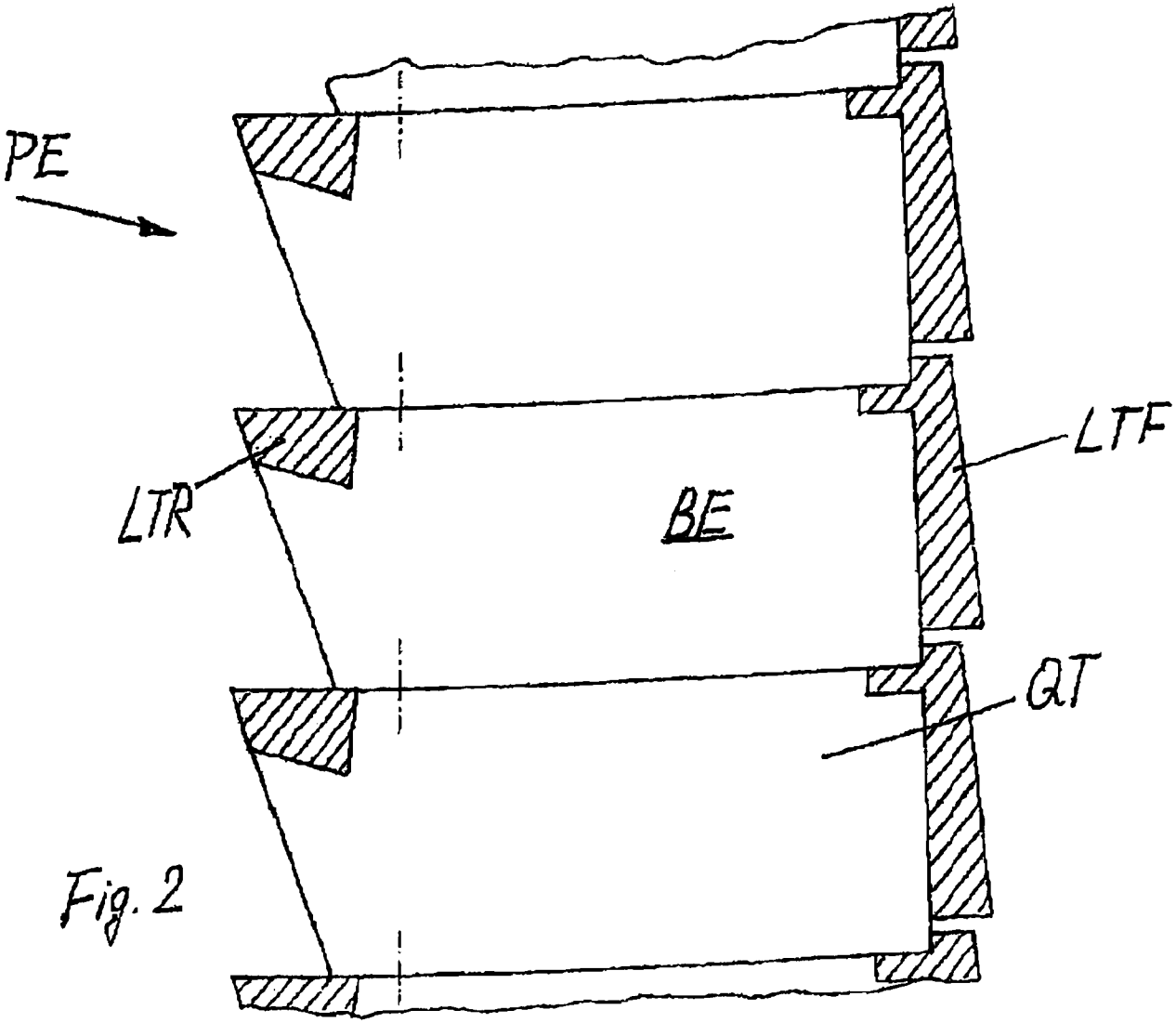
FIG. 2 is another cross sectional view illustrating a plurality of components stacked in a grid pattern.

Outstanding results with the components as claimed in the invention result from use in structures with a material-filled space grid support structure and with talus, slope or filler material on its rear, as are considered especially for retaining walls and/or noise abatement walls. One such structure with a host of components (BE) which are located on top of one another and which are made here for example with a closed one-piece frame is shown in FIG. 2. The compressive forces as a result of the soil backfilling (not detailed) are indicated by the arrow PE.

Figure 3:
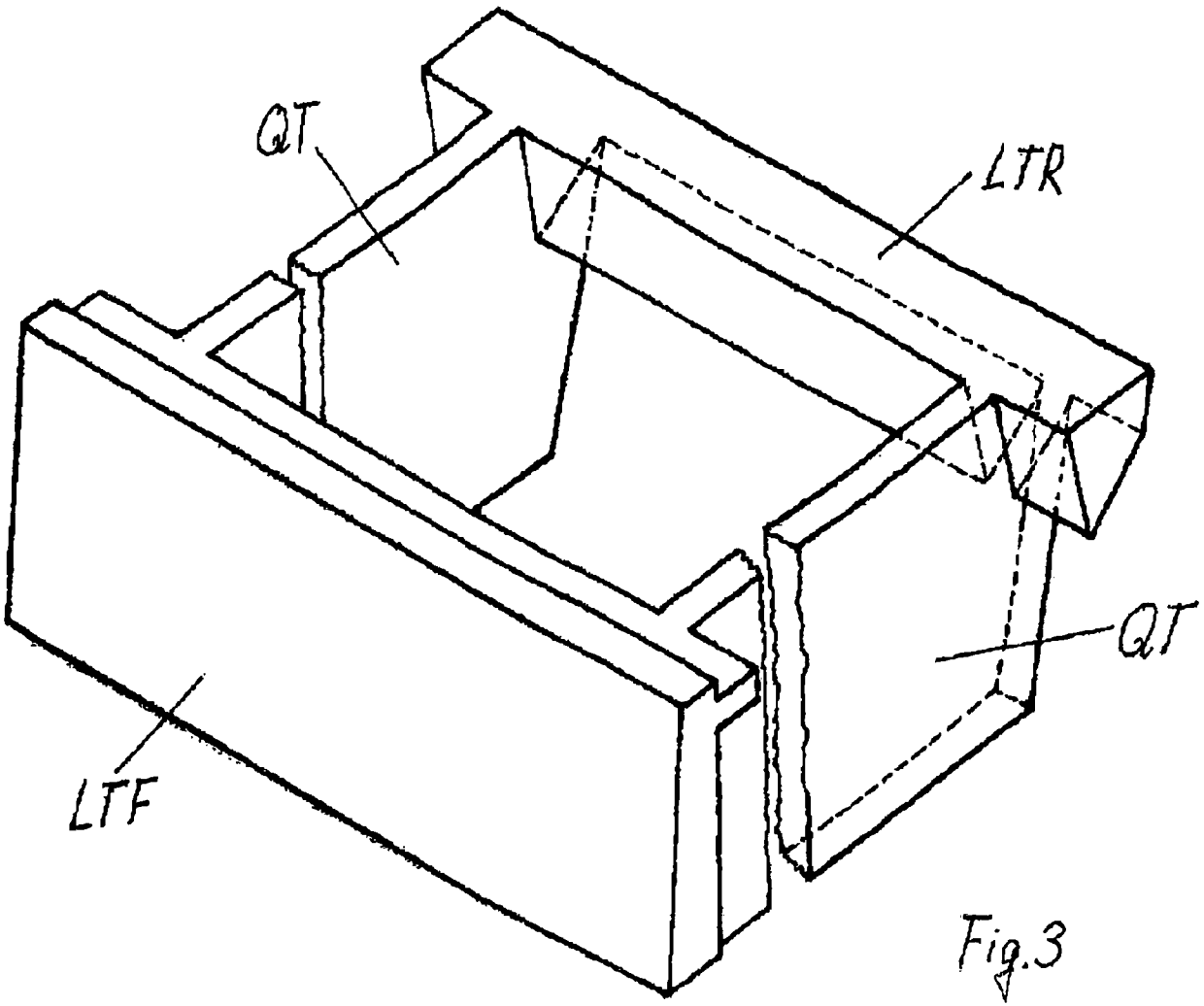
FIG. 3 is a cross sectional view of a rear longitudinal member of the component according to the invention.

FIG. 3 illustrates the frame structure in a perspective of an individual component.

Figure 4:
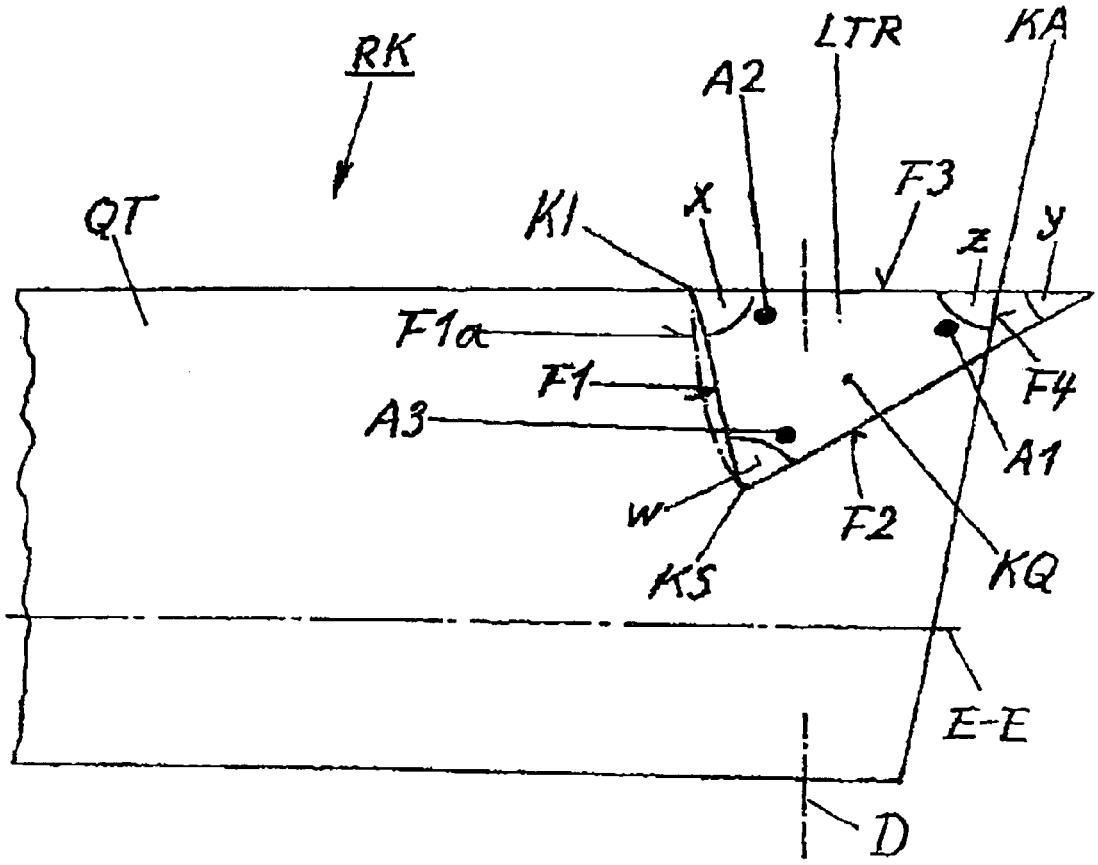
FIG. 4 is a perspective view of the component according to the invention.

FIG. 4 shows an extract of a frame-shaped component with features which can be used especially in combination with those of the preceding structures. The component shown here comprises a frame body RK in which at least in one part of the rear longitudinal member (LTR) the cross sectional height is made increasing or decreasing with respect to the installation position in the direction transversely to the front of the support structure. In particular, the longitudinal member in its area which is the lower one with respect to the installation position comprises a cross sectional area (KQ) which is wedge-shaped with an acute angle and with the wedge vertex (KS) pointed down. In this connection the following features of configuration or dimensions have proven especially advantageous:

The wedge vertex (KS) of the longitudinal member (LTR) pointed down forms an angle (w) of at most approximately 90°, especially of at most approximately 65°. The profile surface (F1) facing the frame interior of the component with the top surface (F3) of the longitudinal member (LTR) which is flat at least in sections forms an angle (x) of at most approximately 88° measured beyond the wedge cross section, especially of at most approximately 80°. Optionally here angular values of at most approximately 50°, especially at most approximately 40° are considered Furthermore, the profile surface (F1) facing the frame interior of the component abuts the top surface (F3) of the longitudinal member (LTR) which is flat at least in sections and thus forms then inside edge (KI) of the component frame. Furthermore, it has proven especially effective if the profile surface (F2) facing the frame exterior of the component with the top surface (F3) of the longitudinal member (LTR) which is flat at least in sections forms an angle (y) of at most approximately 45° measured beyond the wedge cross section, especially of at most approximately 40°. This applies especially if the profile surface (F4) of the longitudinal member (LTR) facing the frame exterior of the component with the top surface of the longitudinal member which is flat at least in sections forms an angle (z) of at most approximately 88° measured beyond the wedge cross section, especially of at most approximately 80°.

A configuration has repeatedly proven itself advantageous in which the profile surface (F4) of the longitudinal member (LTR) facing the frame exterior abuts the top surface of the longitudinal member which is flat at least in sections and forms at least one outside edge (KA) of the component frame.

The configuration as claimed in the invention in an advantageously simple manner allows optimization of the reinforcing position for components consisting of reinforced concrete. To do this, a reinforcing rod (A1) which runs in the lengthwise direction of the member can be located within the cross sectional angle (z) on the outside edge (KA) of the component, which edge is formed by the abutting of the profile surface (F4) of the longitudinal member (LTR), which surface faces the frame exterior, and the top surface (F3) of the longitudinal member which is flat at least in sections.

Therefore FIG. 1 shows one optimization version in which a host of reinforcing rods (A1, A2) are located within the cross section of the longitudinal member in the area of the top of the longitudinal member. In addition, for further optimization there can moreover be a reinforcing rod (A3) which runs in the lengthwise direction of the member within the cross sectional angle (w) on the wedge vertex (KS) of the longitudinal member (LTR) pointed down.

In structures with material-filled space grid support structure and with talus, slope or filler material on its rear, as are considered especially for retaining walls and/or noise abatement walls, longitudinal members (LTR) of the type shown here can be located with their wedge-shaped cross sectional areas (KQ) on the back of the space grid support structure and in the area of the talus, slope or filler material which is located there.

With one of the cited features or especially a combination of several of them, in conjunction with a trapezoidal cross sectional configuration of the longitudinal member the following advanced effects can also be achieved:

The comparatively long diagonal of the cross section of the longitudinal member is especially efficient in static terms because the soil pressure acting from the hillside can be accommodated with a higher resistance moment, also due to the reinforcing rods which lie comparatively far apart.

The side surfaces of the longitudinal member profile which run together at an acute angle allow easy removal of the forms from a frame body which has been produced from concrete. The oblique position of the side surfaces and mainly the comparatively strong oblique location of the bottom surface of the wedge-shaped or trapezoidal profile promotes filling of the space grid wall with soil or bulk material, at least largely free of cavities.

In the tiered arrangement as shown in FIG. 2 the components which are located over one another are secured against shifting by doweling or pinning (D) (here indicated only by the dot-dash lines).

Overall it goes without saying that instead of the closed frame body shown in the examples, also open, for example stirrup-shaped frame bodies can be made and used as claimed in the invention.

It furthermore goes without saying that at least one of the members provided in the component as claimed in the invention can have a cross sectional profile with at least one curved section. As a result the basic function of the polygonal, especially trapezoidal or triangular profiles used or configured as claimed in the invention is not disturbed. On the other hand, in this way useful effects can be achieved, for example with respect to easier removal of forms from the concrete elements. In FIG. 4 in this respect there is a curvature variation F1*a* of the profile surface F1, which version is shown by the dot-dash line.

The invention claimed is:

1. A component for spatial grid supporting systems which holds filler material, comprising:

a body frame having at least one front longitudinal member extending along a front side of the component and at least one cross member extending from a rear surface of the at least one front longitudinal member and at an angle relative to a front surface of the front longitudinal member, each front longitudinal member having a polygonal cross section and generally planar front and rear surfaces, and extending in a direction normal to a frame plane determined by said each front longitudinal member and the at least one cross member;

wherein the front and rear surfaces of the at least one front longitudinal member form an angle between 2° and 15°, said angle opening towards a bottom of said longitudinal member and the front surface of each front longitudinal member is sloped towards an interior of the body frame from a bottom portion to the top portion of the front surface at an angle between 2° and 15° relative to the normal direction.

2. A component for spatial grid supporting systems which holds filler material, comprising:

a body frame having at least one front longitudinal member extending along a front side of the component and at least one cross member extending at an angle from a rear surface of the at least one front longitudinal member, each front longitudinal member having a polygonal cross section and generally planar front and rear surfaces, and extends in a direction normal to a frame plane determined by said each front longitudinal member and the at least one cross member;

wherein at least one projecting flange is mounted on the rear surface of each front longitudinal member and the front and rear surfaces of each front longitudinal member form an angle between 2° and 15°, said angle opening towards a bottom of said each front longitudinal member and the front surface of each front longitudinal member is sloped towards an interior of the body frame from a bottom portion to the top portion of the front surface at an angle between 2° and 15° relative to the normal direction.

3. The component as specified in claim 2 wherein the at least one projecting flange is mounted near an upper portion of the rear surface of each front longitudinal member.

4. The component as specified in claim 2 wherein the front surface of each front longitudinal member is tilted ascending towards an interior of the body frame at an angle between 2° and 15° relative to the normal direction.

5. The component as specified in claim 2 wherein the body frame further comprises at least one rear longitudinal member extending substantially parallel to the at least one front longitudinal member and connected to the at least one cross member, each rear longitudinal member having a plurality of planar surfaces to form a polygonal cross section;

wherein a rear surface of each rear longitudinal member and a rear portion of the at least one cross member are coplanar and slope towards the at least one front longitudinal member from a top of the body frame to a bottom of the body frame; and wherein each rear longitudinal member is wedge shaped and has a pair of lower surfaces intersecting at a vertex edge forming an acute angle, said vertex pointed towards the bottom of the body frame.

6. The component as specified in claim 5 wherein the acute angle is substantially 65°.

7. The component as specified in claim 5 wherein a top surface and a front surface of each rear longitudinal member adjacent the top surface intersect to form a front acute angle of less than 88°.

8. The component as specified in claim 7 wherein the front acute angle between the front surface and the top surface of each rear longitudinal member is substantially 80°.

9. The component as specified in claim 5 wherein the top surface and a bottom surface of each rear longitudinal member form an angle therebetween of less than 45°.

10. The component as specified in claim 5 wherein the top surface and the rear surface of each rear longitudinal member intersect to form an angle therebetween of less than 88°.

11. The component as specified in claim 10 wherein the angle between the top surface and the rear surface of each rear longitudinal member is less than 50°.

12. The component as specified in claim 11 wherein the angle between the top surface and the rear surface of each rear longitudinal member is substantially 40°.

13. The component as specified in claim 12 wherein each rear longitudinal member has a reinforcing rod extending along a length thereof and located near an outside edge formed at the intersection of the top surface and the rear surface of the rear longitudinal member.

14. The component as specified in claim 5 wherein each rear longitudinal member has at least one reinforcing rod extending along a length thereof.

15. The component as specified in claim 14 wherein at the least one reinforcing rod is located near the vertex edge of the rear longitudinal member.

16. The component as specified in claim 5 wherein a top surface of the rear longitudinal member, an upper surface of each cross member and the flange portion are coplanar forming an upper support surface and a lower portion of each cross member forms a lower support surface.

17. A grid support system made of a plurality of the components as specified in claim 16 wherein the lower support surfaces of a components are placed in abutting relationship with the upper surfaces of other components to form a stacked wall.

18. The grid support system as specified in claim 17 wherein a lower portion of the front surfaces of each front longitudinal member extends forward of an upper portion of the front surface of a front longitudinal member located immediately below.

* * * * *